US010589532B2

(12) United States Patent
Tanaka et al.

(10) Patent No.: US 10,589,532 B2
(45) Date of Patent: Mar. 17, 2020

(54) PRINTING APPARATUS AND CONTROL METHOD OF PRINTING APPARATUS

(71) Applicant: SEIKO EPSON CORPORATION, Tokyo (JP)

(72) Inventors: Katsuyuki Tanaka, Matsumoto (JP); Yasumasa Nakajima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/948,773

(22) Filed: Apr. 9, 2018

(65) Prior Publication Data

US 2018/0290455 A1 Oct. 11, 2018

(30) Foreign Application Priority Data

Apr. 10, 2017 (JP) ..... 2017-077369

(51) Int. Cl.

| | |
|---|---|
| ***B41J 29/38*** | (2006.01) |
| ***B41J 2/175*** | (2006.01) |
| ***B41J 2/21*** | (2006.01) |
| ***B41J 2/045*** | (2006.01) |
| ***B41J 2/165*** | (2006.01) |
| ***B41J 2/14*** | (2006.01) |
| ***B41J 29/02*** | (2006.01) |

(52) U.S. Cl.

CPC ..... *B41J 2/17546* (2013.01); *B41J 2/04508* (2013.01); *B41J 2/04581* (2013.01); *B41J 2/14201* (2013.01); *B41J 2/16517* (2013.01); *B41J 2/16552* (2013.01); *B41J 2/1752* (2013.01); *B41J 2/17509* (2013.01); *B41J 2/17553* (2013.01); *B41J 2/2103* (2013.01); *B41J 29/02* (2013.01); *B41J 29/38* (2013.01)

(58) Field of Classification Search

None

See application file for complete search history.

(56) References Cited

U.S. PATENT DOCUMENTS

2004/0223026 A1* 11/2004 Chiun ..... B41J 2/16552 347/22
2009/0185208 A1 7/2009 Yoshizawa et al.
2013/0083100 A1* 4/2013 Yabuki ..... B41J 2/17509 347/7

(Continued)

FOREIGN PATENT DOCUMENTS

GB 2304082 A * 3/1997 ..... B41J 2/1652
JP 2008-238787 A 10/2008

(Continued)

OTHER PUBLICATIONS

Hayakawa Hitoshi, "An Ink Jet Recording Apparatus Capping Arrangement", Mar. 12, 1997, GB, (Year: 1997).*

*Primary Examiner* — Matthew Luu
*Assistant Examiner* — Tracey M McMillion
(74) *Attorney, Agent, or Firm* — Workman Nydegger

(57) ABSTRACT

A printing apparatus provided with a carriage provided with a mounting unit which can be mounted with a cartridge in which ink is accommodated and a printing head, an ink tank which stores ink, and a control unit which controls ejecting of ink using the printing head, in which, in a case in which the control unit obtains information for blocking ejecting of ink corresponding to the mounting unit, ejecting of ink, by the printing head, corresponding to the mounting unit is blocked.

12 Claims, 8 Drawing Sheets

(56) References Cited

U.S. PATENT DOCUMENTS

| | | | | |
|---|---|---|---|---|
| 2013/0327852 | A1* | 12/2013 | Hara | B41J 2/19<br>239/553 |
| 2014/0063144 | A1* | 3/2014 | Nakashima | B41J 2/17503<br>347/86 |
| 2015/0029260 | A1* | 1/2015 | Tanaka | B41J 2/16517<br>347/31 |

FOREIGN PATENT DOCUMENTS

| | | | |
|---|---|---|---|
| JP | 2008-302699 | A | 12/2008 |
| JP | 2014-195907 | A | 10/2014 |

* cited by examiner

FIG. 5

154a

| MOUNTING UNIT | TYPE OF CARTRIDGE | TYPE OF INK | RESIDUAL QUANTITY | USE STATE | SUPPLY OF INK |
|---|---|---|---|---|---|
| 01 | FIXED | C (CYAN) | – | – | – |
| 02 | FIXED | M (MAGENTA) | – | – | – |
| 03 | FIXED | Y (YELLOW) | – | – | – |
| 04 | FIXED | K (BLACK) | – | – | – |
| 11 | FOR EXCHANGE | G (GREEN) | 60% | USED | NORMAL |
| 12 | FOR EXCHANGE | MAINTENANCE LIQUID | 55% | NON-USED | BLOCKED |

PRINTING APPARATUS AND CONTROL METHOD OF PRINTING APPARATUS

BACKGROUND

1. Technical Field

The present invention relates to a printing apparatus and a control method of the printing apparatus.

2. Related Art

In the related art, an ink jet printer on which an ink cartridge is mounted, and which supplies ink from an ink tank has been known (for example, refer to JP-A-2014-195907). In JP-A-2014-195907, an example of an ink jet printer on which an ink cartridge in which ink of each color of cyan, magenta, yellow, and black is accommodated, and which supplies black ink from an ink tank with a larger capacity than the ink cartridge is disclosed.

In a case in which an ink tank with a larger capacity than a general ink cartridge is used, it is known that it is possible to save a time of exchanging the ink cartridge, and reduce a printing cost. Meanwhile, since it is easier to exchange the ink cartridge than the ink tank, it is possible to correspond to a use in which a color of ink which is used in a printer is changed. It is desirable to adopt a usage of taking advantages of these ink cartridge and ink tank.

SUMMARY

An advantage of some aspects of the invention is to perform printing by taking advantage of an ink cartridge, and an ink tank which stores ink, respectively, in a printing apparatus in which ink is used.

According to an aspect of the invention, there is provided a printing apparatus which includes an ink ejecting unit which ejects ink of a plurality of colors; a mounting unit on which a cartridge which accommodates ink can be mounted; a carriage provided with the mounting unit and the ink ejecting unit; an ink storage unit which is disposed at a position different from the carriage, and stores ink; and a control unit which controls ejecting of ink using the ink ejecting unit, in which, in a case of obtaining information for blocking ejecting of the ink corresponding to the mounting unit, the control unit blocks ejecting of the ink corresponding to the mounting unit from the ink ejecting unit.

According to this configuration, the printing apparatus provided with the mounting unit on which the cartridge is mounted and the ink storage unit can block ejecting of ink corresponding to the mounting unit. For example, it is possible to execute an operation of performing printing, or the like, without using ink which is accommodated in the cartridge. Accordingly, it is possible to perform printing by taking advantage of the ink storage unit and the cartridge, respectively.

The apparatus may further include a plurality of the mounting units which can be mounted with the cartridge is provided, in which the control unit may have a configuration of blocking ejecting of the ink corresponding to the mounting unit with respect to any one or more of the plurality of mounting units.

According to this configuration, it is possible to perform printing by using ink stored in the ink storage unit without causing ink accommodated in the cartridge to be ejected. For this reason, it is possible to mount a cartridge accommodating ink of a color with a low use frequency on the mounting unit, or perform printing without mounting the cartridge on the mounting unit, for example. Accordingly, it is possible to properly use the ink storage unit and the cartridge, appropriately, and perform printing by taking advantage of the respective ink storage unit and the cartridge.

The apparatus may further include a cartridge detecting unit which detects a mounting state of the cartridge in the mounting unit, in which the control unit may block ejecting of the ink corresponding to the mounting unit on which the cartridge is not mounted, in a case in which the cartridge detecting unit detects that the cartridge which accommodates ink is not mounted on the mounting unit.

According to this configuration, it is possible to block ejecting of ink corresponding to the mounting unit, in response to a mounting state of the cartridge in the mounting unit. For this reason, for example, it is possible to execute an operation in a state in which the cartridge is not mounted. In this manner, it is possible to properly use the ink storage unit and the cartridge, appropriately, and perform printing by taking advantage of the respective ink storage unit and the cartridge.

The apparatus may further includes a reception unit which receives an input of information related to the cartridge which is mounted on the mounting unit, in which the control unit may block ejecting of the ink from the ink ejecting unit, in a case in which the reception unit receives information for blocking ejecting of the ink.

According to this configuration, it is possible to block ejecting of ink corresponding to the mounting unit based on information which is input related to the cartridge. For example, it is possible to block ejecting of ink which is accommodated in the cartridge according to an input using an input operation by a switch, or the like, or an input of a command or data from an external device. Accordingly, it is possible to perform printing by taking advantage of the respective ink storage unit and cartridge.

In the apparatus, the ink ejecting unit may be provided with a nozzle which ejects the ink, and a supply blocking unit which blocks a flow path for supplying ink to the nozzle from the mounting unit, and the control unit may block ejecting of the ink from the ink ejecting unit by causing the supply blocking unit to block a supply of the ink from the mounting unit.

According to this configuration, it is possible to block a supply of ink to the nozzle from the mounting unit by blocking the ink flow path. For this reason, it is possible to reliably block a supply of ink corresponding to a mounting state, or the like, of the cartridge in the mounting unit.

In the apparatus, the ink ejecting unit may be provided with the nozzle which ejects the ink, and an ejecting driving unit which causes ink to be ejected from the nozzle, in which the control unit may block ejecting of the ink from the ink ejecting unit by causing the ejecting driving unit not to eject the ink from the nozzle.

According to this configuration, it is possible to block ejecting of ink from the mounting unit by not performing an operation of causing ink to be ejected from the nozzle.

In the apparatus, the mounting unit may be mounted with a substitute cartridge in which contents other than printing ink are accommodated, in which the control unit may block ejecting of contents of the substitute cartridge from the ink ejecting unit at a time of printing, in a case in which the substitute cartridge is mounted on the mounting unit.

According to this configuration, it is possible to mount the cartridge in which contents different from printing ink is accommodated on the mounting unit. For example, it is possible to mount a cartridge in which a cleaning solvent which cleans the ink flow path, liquid which prevents drying of the flow path, an object for preventing entering of dust into the flow path, or the like, is accommodated on the mounting unit. For this reason, it is possible to prevent entering of dust, or the like, from the mounting unit, and preferably maintain a state of the printing apparatus without mounting the cartridge in which ink is accommodated. In addition, it is possible to block ejecting of the contents of the cartridge at a time of printing, and prevent the contents different from printing ink from having an influence on printing.

In the apparatus, the contents accommodated in the substitute cartridge may be liquid for maintenance of the printing apparatus.

Here, the liquid for maintenance is, for example, a cleaning solvent for cleaning the ink flow path, liquid for preventing drying of the flow path, or the like. According to this configuration, it is possible to preferably maintain a state of the printing apparatus without mounting the cartridge in which ink is accommodated. In addition, since a condition of the ink flow path is good when mounting the cartridge in which ink is accommodated, it is possible to rapidly start printing in which ink in the cartridge is used.

In the apparatus, a color of ink stored in the ink storage unit may be at least one of colors of yellow, magenta, cyan, and black.

According to this configuration, printing is performed by taking advantage of the ink storage unit, by storing ink of a basic color in subtractive color mixing in the ink storage unit, and using thereof. For example, since the ink storage unit is disposed at a position different from the carriage, it is possible to easily make the ink storage unit have a larger capacity than that of the cartridge which is mounted on the mounting unit of the carriage. For this reason, it is possible to save a time of exchanging the cartridge, and reduce a printing cost, or the like, by storing ink which is consumed a lot in printing in which subtractive color mixing is used in the ink storage unit.

In the apparatus, a color of ink accommodated in the cartridge may be a color which is not the basic color in subtractive color mixing.

According to this configuration, it is possible to easily change ink of a color other than the basic color by exchanging the cartridge, by supplying ink of a color which is not a basic color in subtractive color mixing using the cartridge. In addition, it is possible to print various printed matters by combining ink stored in the ink storage unit and ink supplied by the cartridge. In addition, in a case in which a basic color which is used in the subtractive color mixing is stored in the ink storage unit, for example, it is possible to use or exchange ink of a color other than the basic color, in a state in which printing can be performed using ink of the basic color.

In the apparatus, a color of ink accommodated in the cartridge may be any one of colors of red, green, fluorescent, and metallic.

According to this configuration, ink of a color which is not the basic color in subtractive color mixing, and with a limited case of being used is supplied by the cartridge. There is an advantage of slow deterioration in ink accommodated in the cartridge, and it is possible to prevent deterioration in printing quality by supplying ink of colors with a low use frequency using the cartridge. In addition, it is possible to easily change a color of ink since it is possible to easily exchange the cartridge. Accordingly, it is possible to perform printing by taking advantage of supplying ink from the cartridge.

According to another aspect of the invention, there is provided a control method of a printing apparatus which includes an ink ejecting unit which ejects ink of a plurality of colors; a mounting unit on which a cartridge which accommodates ink can be mounted; a carriage provided with the mounting unit and the ink ejecting unit; and an ink storage unit which is disposed at a position different from the carriage, and stores ink, the method including blocking ejecting of the ink corresponding to the mounting unit from the ink ejecting unit, in a case of obtaining information for blocking ejecting of the ink corresponding to the mounting unit.

According to this configuration, the printing apparatus provided with the mounting unit on which the cartridge is mounted and the ink storage unit can block ejecting of ink corresponding to the mounting unit. For example, it is possible to perform an operation of printing, or the like, without using ink accommodated in the cartridge. Accordingly, it is possible to perform printing by taking advantage of the respective ink storage unit and the cartridge.

The invention also can be executed in various forms other than the above described printing apparatus and control method of the printing apparatus. For example, it is possible to execute the invention in a form of a program for executing the above described control method using a computer, a recording medium in which the above described program is recorded, a server which distributes the program, a transmission medium which transmits the program, and a data signal, or the like, in which the program is embodied in a carrier wave.

BRIEF DESCRIPTION OF THE DRAWINGS

The invention will be described with reference to the accompanying drawings, wherein like numbers reference like elements.

FIG. 5 is a schematic view which illustrates a configuration example of cartridge data.

DESCRIPTION OF EXEMPLARY EMBODIMENTS

1. Configuration of Printer

Hereinafter, an embodiment of the invention will be described with reference to drawings.

Figure 1:
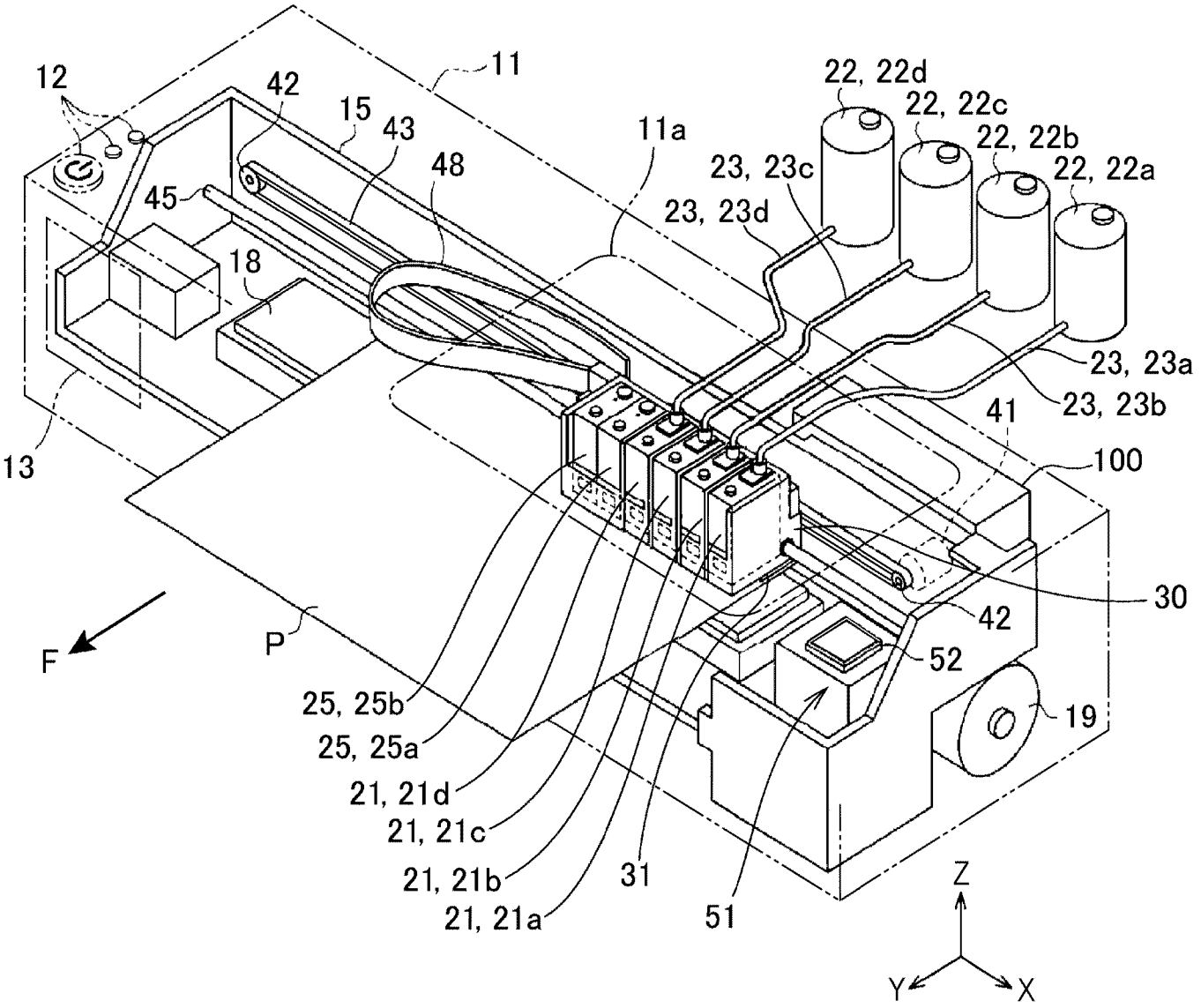
FIG. 1 is a perspective view which illustrates a schematic configuration of a printer according to an embodiment of the invention.

FIG. 1 is a perspective view which illustrates a schematic configuration of a printer 1 according to an embodiment to which the invention is applied. In the figure, the higher part in an installation state of the printer 1 is denoted by a reference Z, the left direction is denoted by a mark X, and the front direction is denoted by a mark Y.

The printer 1 is provided with a housing 11 which is formed in a rectangular parallelepiped shape, approximately.

An operation unit 12 which is operated by a user who uses the printer 1 is disposed on a top face of the housing 11. The operation unit 12 is provided with a power switch of the printer 1, an operation switch for performing setting, or the like, of the printer 1, and the like. In addition, a display panel 13 is disposed on the front face PLU file the housing 11. The display panel 13 is provided with a liquid crystal display panel, or the like, and displays an operation state of the printer 1, operation contents using the operation unit 12, and the like.

An opening portion 11*a* is opened on a top face of the housing 11. The opening portion 11*a* is provided with a lid which is openable and closeable (not illustrated). The opening portion 11*a* is opened by a user when a work of exchanging a cartridge 25 which is mounted on the carriage 30 (which will be described later), or the like, is performed.

A frame 15 which supports a mechanism of the printer 1 is disposed inside the housing 11. A transport motor 19 which transports a printing sheet P as a printing medium which is printed by the printer 1 is attached to the frame 15. The transport motor 19 is connected to a transport roller (not illustrated) through a gear or a ring mechanism illustrated). The transport roller (not illustrated) comes into contact with the printing sheet P, rotates by a driving force of the transport motor 19, and transports the printing sheet P in a transport direction which is denoted by a mark F in the figure.

A printing medium as a printing target of the printer 1 may be formed in a sheet shape, and may be any one of a cut sheet which is cut into a predetermined size, and a roll sheet obtained by winding a continuous sheet in a roll shape. These sheets may be paper, cloth, or non-woven fabric, or may be a synthetic resin sheet. In addition, coating may be applied to the front surface of these sheets. In the embodiment, as an example, a case in which the printing sheet P which is cut paper is used as the printing medium will be exemplified.

The printer 1 includes the carriage 30 which is subject to scanning in a reciprocating manner in a direction orthogonal to the transport direction F. The carriage 30 is mounted with a printing head 31 (ink ejecting unit). The printing head 31 forms dots on the printing sheet P by ejecting ink onto the printing sheet P, and prints an image on the printing sheet P in this manner. A direction in which the carriage 30 is subject to scanning is the direction X in the figure, and a direction opposite thereto.

The printer 1 is provided with a carriage motor 41 which drives the carriage 30. The carriage motor 41 is provided at an end portion of the housing 11 in a width direction of the housing 11, that is, the scanning direction of the carriage 30. A pulley 42 is attached to an output shaft of the carriage motor 41. In addition, a pulley 42 is fixed to an end of the housing 11 on a side opposite to the carriage motor 41. The pulley 42 attached to the carriage motor 41 is a driving pulley which rotates by a driving force of the carriage motor 41. The other pulley 42 is a driven pulley which is rotatably attached to the frame 15. A belt 43 is stretched over the pair of pulleys 42, and when one pulley 42 rotates by the driving force of the carriage motor 41, the belt 43 is driven between the pair of pulleys 42.

The belt 43 is attached to the carriage 30, and the carriage 30 moves along a carriage guide shaft 45 when the belt 43 is driven. Accordingly, the carriage 30 is subject to scanning on the printing sheet P in a reciprocating manner along with the rotation of the carriage motor 41. In this manner, the printing head 31 moves on the printing sheet P, and printing on the printing sheet P can be performed.

The carriage motor 41 can perform a normal rotation and a reversal rotation, and a direction in which the carriage 30 moves corresponds to a rotation direction of the carriage motor 41.

The printer 1 is provided with a control device 100 which performs a driving control of the transport motor 19 and the carriage motor 41, ink ejecting control using the printing head 31, a display control of the display panel 13, and the like. The printing head 31, IC reading units 34*a*, 34*b*, 34*c*, 34*d*, 39*a*, and 39*b* (FIG. 2), and the like, which will be described later, and a flat cable 48 which connects the control device 100 are connected to the carriage 30.

In addition, a platen 18 which is located under the printing sheet P is fixed to the frame 15. The platen 18 supports the printing sheet P from under at a position facing the printing head 31.

Sub-tanks 21*a*, 21*b*, 21*c*, and 21*d* which supply ink ejected from the printing head 31, and cartridges 25*a* and 25*b* are mounted on the carriage 30. The cartridges 25*a* and 25*b* are cartridges which can accommodate ink in the inside, respectively, and can be detached from the carriage 30.

The sub-tanks 21*a* to 21*d* are connected to ink tanks 22*a*, 22*b*, 22*c*, and 22*d*, respectively. The respective sub-tanks 21*a* to 21*d* temporarily store ink which is supplied from the ink tanks 22*a* to 22*d*, and supply the ink to the printing head 31. In addition, the cartridges 25*a* and 25*b* (cartridge 25) correspond to the cartridge in the invention.

The ink tanks 22*a* to 22*d* (ink storage unit) have ink inlets, respectively, and can be replenished with ink from the ink inlets. For this reason, in a case in which a remaining amount of ink stored inside the ink tanks 22*a* to 22*d* is reduced, it is possible to continuously use ink without exchanging the ink tanks 22*a* to 22*d* and the sub-tank 21*a* to 21*d* when ink is replenished from the ink inlet.

The ink tanks 22*a* to 22*d* are provided at a location different from the carriage 30, as illustrated in FIG. 1. For example, the printer 1 can be configured so as to be provided with an installation unit (not illustrated) for attaching the ink tanks 22*a* to 22*d*. In addition, it is not necessary to dispose all of the ink tanks 22*a* to 22*d* in one place, and may dispose the ink tanks at a plurality of positions by distributing thereof.

In the following descriptions, in a case in which the sub-tanks 21*a* to 21*d* are not classified, the sub-tanks are described as a sub-tank 21, and in a case in which the cartridges 25*a* and 25*b* are not classified, the cartridge will be described as a cartridge 25. Similarly, in a case in which the ink tanks 22*a*, 22*b*, 22*c*, and 22*d* are not classified, the ink tanks will be described as an ink tank 22.

In addition, similarly, nozzles 32*a*, 32*b*, 32*c*, 32*d*, 32*e*, and 32*f* (FIG. 2) are described as a nozzle 32 in a case of not being classified.

The sub-tank 21, the cartridge 25, and the ink tank 22 will be described later with reference to FIG. 2.

A home position 51 is provided at an end portion in a range in which the printing head 31 is subject to scanning. In the example in FIG. 1, in the housing 11, the home position 51 is located at one end on the side in which the carriage motor 41 is provided. The home position 51 is a position of the printing head 31 when performing maintenance of the printing head 31, and is a reference position in a scanning range of the printing head 31.

A maintenance device 52 is provided at the home position 51. The maintenance device 52 is provided with an ink reception unit (not illustrated) which receives ink ejected by the printing head 31, and a cap (not illustrated) which seals the printing head 31.

The printer 1 executes cleaning and flushing of the printing head 31 as maintenance of the printing head 31, as will be described later. The cleaning is an operation for removing and preventing clogging of a flow path through which ink flows in the printing head 31, and the nozzle 32 (FIG. 2) through which the printing head 31 ejects ink. When performing cleaning, the printer 1 causes the printing head 31 to be located on the maintenance device 52, and discharges ink toward the maintenance device 52 from the printing head 31. At this time, when ink passes through the carriage 30, an ink flow path in the inside of the printing head 31, and the nozzles 32*a* to 32*f*, a cleaning effect, and a bubble removing effect of these paths can be expected.

Figure 2:
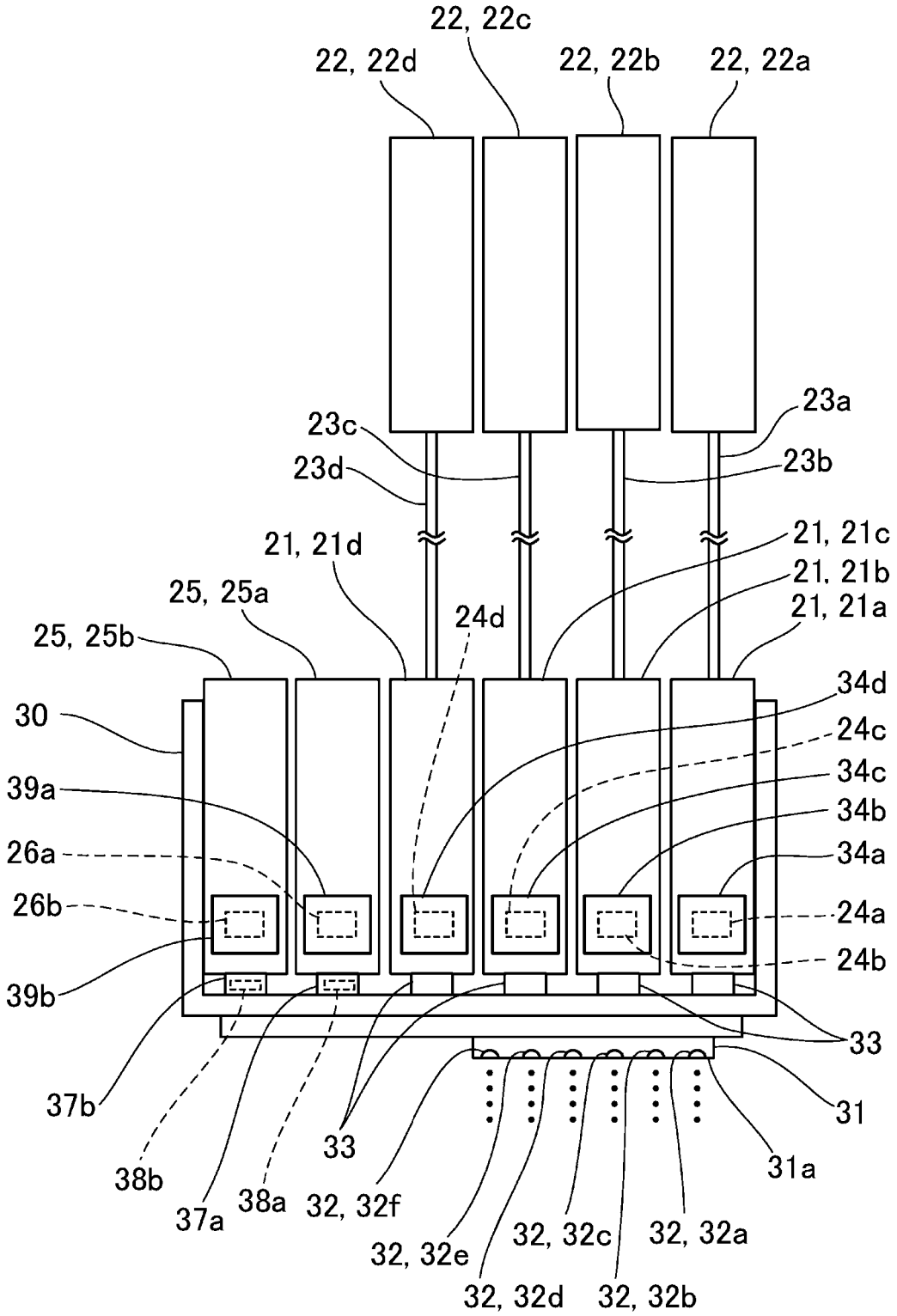
FIG. 2 is a schematic view which illustrates a configuration of a carriage and vicinity thereof.

The flushing is an operation for preventing a deterioration in printing quality due to a change in ink in the nozzle 32 (FIG. 2). When perform flushing, the printer 1 performs an operation of causing ink to be ejected from each nozzle 32, and discharges ink which remains at an opening of the nozzle 32, and the vicinity thereof. In this manner, in a case in which ink which stays in the nozzle 32 is changed in property such as an increase in viscosity due to drying, when the ink is discharged, it is possible to maintain a state in which the printing head 31 can discharge ink with high quality. In addition, it is possible to control a meniscus of ink in the opening of the nozzle 32, and make a size of ink droplets which are ejected to the printing sheet P an appropriate size using flushing.

2. Configurations of Carriage and Cartridge

FIG. 2 is a schematic view which illustrates a configuration of the carriage 30, and the vicinity thereof. FIG. 2 illustrates the carriage 30, the sub-tanks 21*a* to 21*d* which are mounted on the carriage 30, the cartridges 25*a* and 25*b*, and configurations which belong to these in a front view.

The carriage 30 is provided with a plurality of mounting units 33 which can be mounted with the sub-tank 21 in a detachable manner. There is no limit in the number of sub-tanks 21 which is mounted on the carriage 30; however, in the embodiment, the carriage 30 can be mounted with four sub-tanks 21, and is provided with four mounting units 33. Each of the mounting units 33 supplies ink in the inside of the sub-tank 21 to the printing head 31 in a state of being mounted with the sub-tank 21.

The carriage 30 is provided with IC reading units 39*a* and 39*b* on which the cartridges 25*a* and 25*b* are mounted. According to the embodiment, the carriage 30 is configured so as to be mounted with the two cartridges 25, and is provided with four mounting units 33. Each of the mounting units 33 supplies ink in the inside of the sub-tank 21 to the printing head 31 in a state of being mounted with the sub-tank 21.

The sub-tank 21*a* is connected to the ink tank 22*a* using an ink supply tube 23*a*, and ink stored inside the ink tank 22*a* is transported to the sub-tank 21*a* using the ink supply tube 23*a*. The sub-tank 21*a* includes a space (not illustrated) for temporarily storing ink which is transported through the ink supply tube 23*a*, and the ink stored in the space is sent to the printing head 31. The ink supply tube 23*a* may be provided with a driving unit for transporting ink from the ink tank 22*a* to the sub-tank 21*a*. In addition, it may be a configuration in which ink in the ink tank 22*a* is suctioned to the sub-tank 21*a* through the ink supply tube 23*a*, using a suction force which is generated along with ejection, every time the ink stored in the sub-tank 21*a* is ejected by the printing head 31.

The sub-tanks 21*b* to 21*d* are connected to the ink tanks 22*b* to 22*d*, respectively, using ink supply tubes 23*b* to 23*d*, similarly to the sub-tank 21*a*. Ink stored in the ink tanks 22*b* to 22*d* are transported to the sub-tanks 21*b* to 21*d* through the ink supply tubes 23*b* to 23*d*.

Ink stored in the ink tanks 22*a* to 22*d* is sent from each of the sub-tanks 21*a* to 21*d* to the printing head 31 through the mounting unit 33, and is ejected onto the printing sheet P using the printing head 31.

Meanwhile, the cartridges 25*a* and 25*b* include a space (not illustrated) for storing ink, respectively, and ink accommodated in the space is supplied to the printing head 31 through mounting units 37*a* and 37*b*.

A blocking unit 38*a* is built in the mounting unit 37*a*. The blocking unit 38*a* (supply blocking unit) has a function of blocking a supply of ink from the cartridge 25*a* to the printing head 31. In addition, a blocking unit 38*b* (supply blocking unit) is built in the mounting unit 37*b*. The blocking unit 38*b* has a function of blocking a supply of ink from the cartridge 25*b* to the printing head 31. The blocking units 38*a* and 38*b* are connected to the control device 100 (FIG. 3), respectively, and can be switched between a state of blocking a supply of ink and a state of supplying ink due to a control of the control unit 100. The mounting units 37*a* and 37*b* correspond to the mounting unit in the invention.

In the printing head 31, the nozzles 32*a*, 32*b*, 32*c*, 32*d*, 32*e*, and 32*f* are opened on a nozzle forming face 31*a* as a face which faces the platen 18 (FIG. 1). The nozzles 32*a* to 32*f* may be one nozzle opening, respectively, or each of the nozzles may be a nozzle column configured of a plurality of nozzles. That is, each of the nozzles 32*a* to 32*f* can be referred to as a nozzle column.

The nozzle 32*a* is a nozzle corresponding to the sub-tank 21*a*, and ejects ink supplied from the sub-tank 21*a*. The carriage 30 is provided with an ink flow path (not illustrated) which is formed from the sub-tank 21*a* to the nozzle 32*a* through the mounting unit 33.

Similarly, each of the nozzle 32*b*, 32*c*, and 32*d* are nozzles corresponding to the sub-tanks 21*b* to 21*d*, and ejects ink supplied from the sub-tanks 21*b* to 21*d*. The carriage 30 is provided with an ink flow path (not illustrated) which reaches the respective nozzles 32*b* to 32*d* from each the respective sub-tanks 21*b* to 21*d* through the mounting unit 33. The nozzle 32*e* is a nozzle corresponding to the cartridge 25*a*, and the nozzle 32*f* is a nozzle corresponding to the cartridge 25*b*. These nozzles 32*e* and 32*f* correspond to the nozzles in the invention.

The carriage 30 is provided with an ink flow path (not illustrated) which reaches the nozzles 32*e* from the cartridge 25*a* through the mounting unit 37*a*, and an ink flow path (not illustrated) which reaches the nozzles 32*f* from the cartridge 25*b* through the mounting unit 37*b*. The ink flow path which reaches the nozzles 32*e* from the cartridge 25*a* can be blocked by the blocking unit 38*a*, and the ink flow path which reaches the nozzles 32*f* from the cartridge 25*b* can be blocked by the blocking unit 38*b*.

An integrated circuit (IC) 24*a* is mounted on the sub-tank 21*a*. The carriage 30 is provided with an IC reading unit 34*a* in response to the IC 24*a*. The IC 24*a* is an IC memory element of a contact-type or a non-contact type which includes a storage region (not illustrated) in which data is stored. The IC reading unit 34*a* communicates with the IC 24*a* in a contact manner or a non-contact manner, and reads data stored in the IC 24*a*.

Similarly, ICs 24*b* to 24*d* are mounted on the sub-tanks 21*b* to 21*d*. The carriage 30 is provided with IC reading units 34*b* to 34*d* in response to each of the ICs 24*b* to 24*d*. The ICs 24*b* to 24*d* are IC memory elements of a contact-type or a non-contact type which include storage regions (not illustrated) in which data are stored. The IC reading units 34*b* to 34*d* respectively communicate with the ICs 24*b* to 24*d*, respectively in a contact manner or a non-contact manner, and reads data stored in the ICs 24*b* to 24*d*.

The ICs 24*a* to 24*d* respectively store color data, or the like, which denotes a color of ink supplied to the printing head 31 by the sub-tanks 21*a* to 21*d*.

ICs 26*a* and 26*b* are mounted on each of the cartridges 25*a* and 25*b*. The carriage 30 is provided with IC reading units 39*a* and 39*b* in response to each of the ICs 26*a* and 26*b*. The ICs 26*a* and 26*b* are IC memory elements of a contact-type or a non-contact type which include a storage region (not illustrated) in which data is stored. Each of the IC reading units 39*a* and 39*b* communicates with the ICs 26*a* and 26*b* in a contact manner or a non-contact manner, and reads data which is stored in the ICs 26*a* and 26*b*.

The ICs 26*a* and 26*b* can store various data related to the cartridges 25*a* and 25*b*. For example, the ICs 26*a* and 26*b* store color data which denotes a color of ink accommodated in the cartridges 25*a* and 25*b*. In addition, the ICs 26*a* and 26*b* respectively store data of residual quantity which denotes a residual quantity of ink which is accommodated in the cartridges 25*a* and 25*b*.

In this manner, the printer 1 can print characters or an image on the printing sheet P by ejecting ink stored in the ink tank 22 using the printing head 31, by the sub-tank 21 which is mounted on the carriage 30. In addition, the printer 1 ejects ink accommodated in the cartridges 25*a* and 25*b* using the printing head 31, and can perform printing on the printing sheet P using the ink.

A color of ink stored in each of the ink tanks 22*a* to 22*d*, and a color of ink accommodated in each of the cartridges 25*a* and 25*b* may be any color. Each of the cartridges 25*a* and 25*b* can be detached from the carriage 30, and for example, can be exchanged with a cartridge 25 in which ink of another color is accommodated. In addition, the cartridges 25*a* and 25*b* are disposable cartridges, for example, and are exchanged with a new cartridge 25 in a case in which ink accommodated inside is exhausted.

The sub-tanks 21*a* to 21*d* may have a configuration of being fixed to the printer 1 along with the ink tanks 22*a* to 22*d*. In addition, the sub-tank 21 may be detached from the carriage 30, and for example, the sub-tank 21*a* may be detached from the carriage 30 along with the ink supply tube 23*a* and the ink tank 22*a*. In this case, an ink tank 22 which stores a different ink, and an ink supply tube 23 and a sub-tank 21 which belong to the ink tank 22 may be exchanged.

3. Control System of Printer

Figure 3:
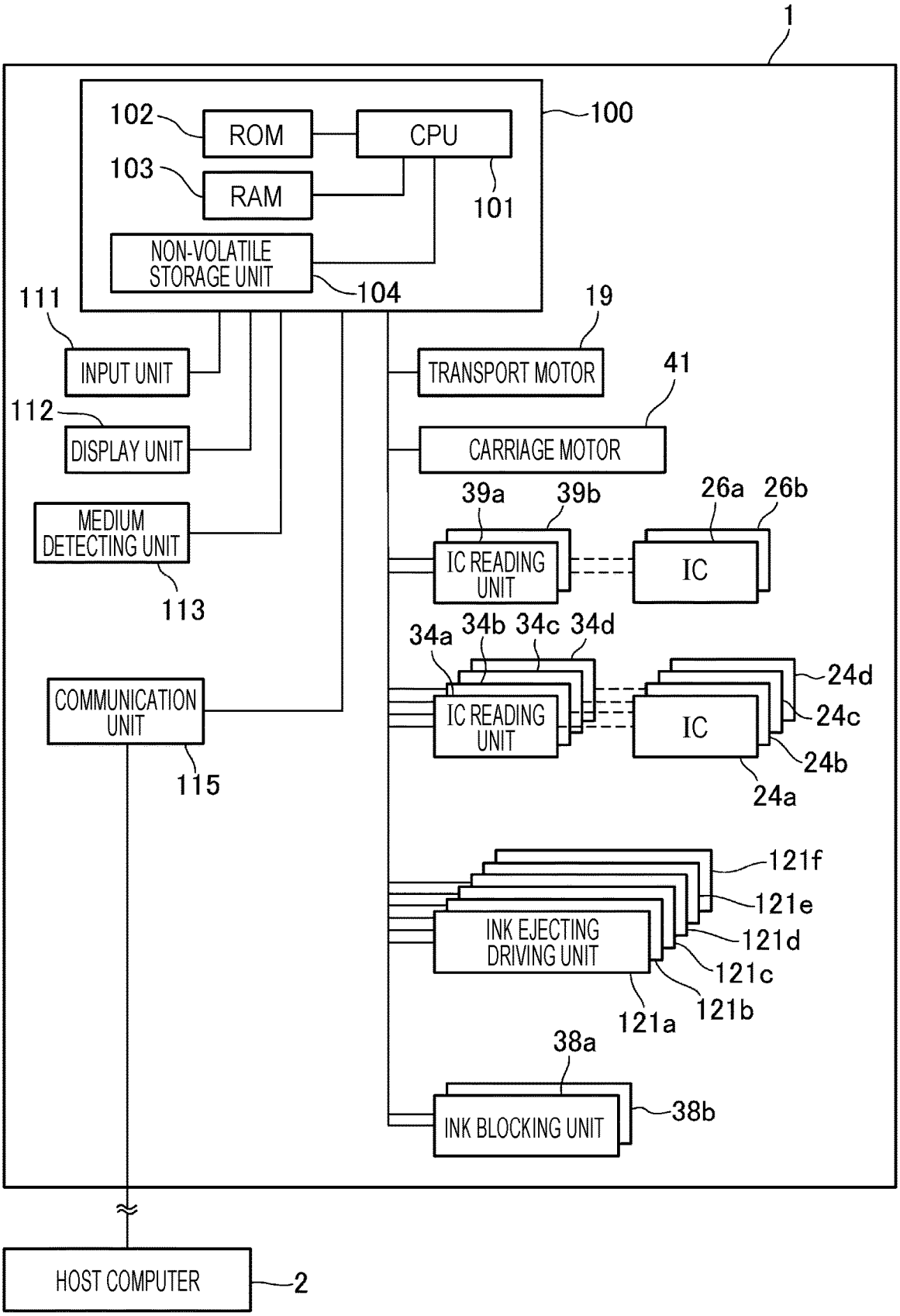
FIG. 3 is a block diagram of the printer.

FIG. 3 is a block diagram which illustrates a configuration of the printer 1.

The control device 100 is formed in a box shape as illustrated in FIG. 1, includes a control board on which a semiconductor device, or the like, is mounted in the inside, and a configuration of the control board is illustrated in FIG. 3.

The control device 100 is provided with a central processing unit (CPU) 101, a read only memory (ROM) 102, a random access memory (RAM) 103, and a non-volatile storage unit 104.

The CPU 101 executes a function of a control unit 140 (FIG. 4) which will be described later by executing a program which is stored in the ROM 102 or the non-volatile storage unit 104, and controls each unit of the printer 1. The ROM 102 stores a program which is executed by the CPU 101, data of a set value, or the like, in a non-volatile manner. The RAM 103 functions as a memory which temporarily stores a program which is executed by the CPU 101, or data to be processed. The non-volatile storage unit 104 is configured of a semiconductor element such as a flash memory device, a magnetic storage device, an optical storage device, or the like, and stores a program executed by the CPU 101, data of a set value, or the like, in a non-volatile manner.

The transport motor 19, the carriage motor 41, an input unit 111, a display unit 112, a medium detecting unit 113, a communication unit 115 are connected to the control device 100 as a control target. The input unit 111 detects an operation with respect to the operation unit 12 (FIG. 1), and outputs data denoting an operation result to the control device 100. The display unit 112 drives the display panel 13 (FIG. 1) according to a control of the control device 100, and causes the display panel to display various information.

The medium detecting unit 113 is a sensor for detecting a position of the printing sheet P (FIG. 1) which is set in the printer 1, at a tip end, a rear end, and a side end, or a size of the printing sheet P in the scanning direction of the carriage 30. The medium detecting unit 113 executes detecting according to a control of the control device 100, and outputs a detection result to the control device 100.

The communication unit 115 is connected to a host computer 2 as an external device of the printer 1 in a wired manner using a cable (not illustrated), or is connected thereto in a wireless manner using a radio communication line. The communication unit 115 receives a command or data which is sent by the host computer 2, and output thereof to the control device 100. In addition, the communication unit 115 sends various data to the host computer 2 based on a control of the control device 100.

The transport motor 19 rotates according to a control of the control device 100, as described above, and transports the printing sheet P by driving a transport roller (not illustrated). The carriage motor 41 performs a normal rotation or a reversal rotation according to a control of the control device 100, as described above, and moves the carriage 30.

In addition, the IC reading units 34*a* to 34*d*, the blocking units 38*a* and 38*b*, the IC reading units 39*a* and 39*b*, and ink ejecting driving units 121*a* to 121*f* (ejecting driving unit) are connected to the control device 100.

The IC reading units 34*a* to 34*d* read data recorded in the IC 24*a* to 24*d* according to a control of the control device 100, and writes data with respect to the IC 24*a* to 24*d*.

The IC reading units 39*a* and 39*b* read data recorded in the ICs 26*a* and 26*b*, and write data with respect to the ICs 26*a* and 26*b* according to a control of the control device 100.

The blocking units 38*a* and 38*b* switch a state in which the ink flow path from the cartridges 25*a* and 25*b* to the printing head 31 is blocked and a state in which the ink flow path is not blocked (state in which ink can be supplied) according to a control of the control device 100.

The ink ejecting driving units 121*a* to 121*f* causes ink to be ejected from the nozzles 32*a* to 32*f* of the printing head 31 according to a control of the control device 100. The ink ejecting driving units 121*a* to 121*f* are mounted on the printing head 31, and are provided at a position corresponding to the nozzles 32*a* to 32*e*.

More specifically, the ink ejecting driving unit 121*a* is provided with an ink storage chamber (not illustrated) which is connected to a flow path of ink which is supplied by the sub-tank 21*a*, and an ejecting mechanism (not illustrated) which pushes out ink from the ink storage chamber to the nozzles 32*a*. The ink ejecting driving unit 121*a* pushes out ink to the nozzle 32*a*, and causes ink to be ejected from the nozzle 32*a* using a control of the control device 100.

Similarly, the ink ejecting driving units 121*b* to 121*f* execute an ink pushing-out operation, and causes ink to be ejected from the nozzles 32*b* to 32*f* of the printing head 31 according to a control of the control device 100.

The respective ink ejecting driving units 121*a* to 121*f* can be independently controlled by the control device 100. For this reason, the control device 100 can control ejecting of ink from the printing head 31 in each of the nozzles 32*a* to 32*f*, and can control ejecting of ink in each color.

Figure 4:
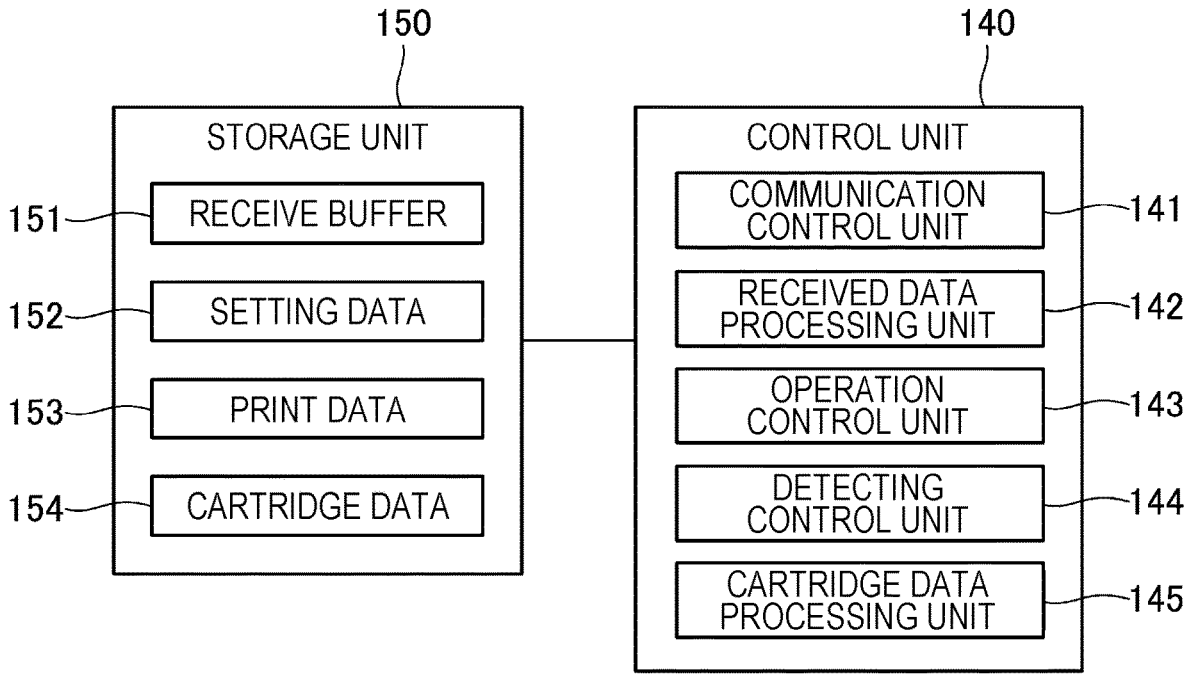
FIG. 4 is functional block diagrams of a control unit and the storage unit.

FIG. 4 is a functional block diagram of the control unit 140 and a storage unit 150. FIG. 4 illustrates a functional configuration of the control unit 140 and the storage unit 150. The storage unit 150 is a logical storage unit which is configured of the non-volatile storage unit 104 (FIG. 3) or the ROM 102.

The storage unit 150 can store various data which are processed by the control unit 140, is provided with a receive buffer 151, for example, and stores set data 152, print data 153, and cartridge data 154.

The receive buffer 151 is a temporary storage region which is realized by using a part of a storage region of the storage unit 150, and temporarily stores a command or data received from the host computer 2. Data received by the communication unit 115 is temporarily stored in the receive buffer 151, is analyzed by the storage unit 150, and is processed thereafter.

The set data 152 includes data for setting an operation of the printer 1. For example, the set data 152 includes data related to communication setting with the host computer 2, setting of a size or a type of the printing sheet P, and setting of executing conditions, an executing timing, or setting of an executing frequency of cleaning or flushing which will be described later.

The print data 153 is data for printing which is generated by the storage unit 150 based on data which is sent by the host computer 2. The print data 153 includes, for example, data such as an amount of ink which the printing head 31 ejects from the nozzles 32*a* to 32*f*, a size of ink droplets, or the like.

The cartridge data 154 includes data which is read by the IC reading units 34*a* to 34*d*, 39*a*, and 39*b*.

FIG. 5 illustrates a configuration example of the cartridge data 154.

Cartridge data 154*a* illustrated in FIG. 5 is an example of the cartridge data 154 (FIG. 4), and includes data corresponding to the four sub-tanks 21 and the two cartridges 25 which are mounted on the carriage 30.

The cartridge data 154*a* includes data which denotes a type of the cartridge, a type on ink, a residual quantity of ink, a use state, and data denoting whether or not there is a supply of ink, with respect to each of the mounting units 33, 37*a*, and 37*b* included in the carriage 30. The cartridge data 154*a* includes, for example, numbers as information for identifying the mounting units 33, 37*a*, and 37*b*, and for example, in the example in FIG. 5, numbers of 01 to 04 (identification information) are given to the mounting unit 33, and numbers 11 and 12 (identification information) are given to the mounting units 37*a* and 37*b*.

The type of the cartridge is information for distinguishing the sub-tank 21 which is connected to the ink tank 22 from the cartridge 25 which is subjected to be exchanged. In the example in FIG. 5, it is denoted that the mounting unit 33 with numbers 01 to 04 is mounted with the sub-tank 21 which is connected to the ink tank 22, and the mounting units 37*a* and 37*b* are mounted with the cartridge 25.

The type of ink, and the residual quantity of ink are based on data which is read by the IC reading units 34*a* to 34*d*, 39*a*, and 39*b*.

The type of ink denotes, for example, a color of ink. In the example in FIG. 5, it is denoted that colors of ink of the four mounting units 33 are cyan (C), magenta (M), yellow (Y), and black (K), respectively. In the cartridge data 154*a*, it is denoted that a color of ink of the mounting unit 37*a* is green (G). In addition, it is denoted that the cartridge 25*b* in which maintenance liquid is accommodated is mounted on the mounting unit 37*b*. In the type of ink, data which is read by the IC reading units 34*a* to 34*d*, 39*a*, and 39*b* are included.

In the residual ink quantity, data which is read by the IC reading units 34*a* to 34*d*, 39*a*, and 39*b* is set. Every time the printer 1 ejects ink from the printing head 31, data of residual quantity of ink of the cartridge data 154*a* is subtracted by the storage unit 150. In the example in FIG. 5, a residual quantity of ink is included with respect to the mounting units 37*a* and 37*b* on which a cartridge 25 with a high necessity of managing the residual quantity of ink is mounted. A management of a residual quantity of maintenance liquid may be omitted with respect to the mounting unit 37*b* corresponding to the cartridge 25*b* in which maintenance liquid is accommodated. In addition, data of residual quantity of ink of the sub-tank 21 or the ink tank 22 may be set with respect to each of the mounting units 33.

The use state is data which denotes whether or not ink or liquid accommodated in the cartridge 25 is to be used in printing, with respect to the mounting units 37*a* and 37*b* as mounting units from which the cartridge 25*b* can be detached. The cartridge 25 mounted on the mounting unit 37*b* accommodates maintenance liquid, and the maintenance liquid is not used in printing. For this reason, in the cartridge data 154*a*, a use state of the mounting unit 37*b* is set to "non-use".

The supply of ink is data which denotes whether or not to block a supply of ink using the blocking units 38*a* and 38*b*, with respect to the mounting units 37*a* and 37*b* as mounting units from which the cartridge 25 can be detached. The cartridge 25*b* mounted on the mounting unit 37*b* accommodates maintenance liquid, and the maintenance liquid is not used in printing. For this reason, in the cartridge data 154*a*, it is set so that a supply of maintenance liquid is blocked by the blocking unit 38*b* at a time of printing.

In addition to this, the storage unit 150 illustrated in FIG. 4 may include data of a screen displayed on the display unit 112 under a control of the storage unit 150, font data of characters which is printed in the printer 1, print data for test printing, or the like.

The control unit 140, and various functional units included in the control unit 140 are formed by a cooperation between software and hardware when the CPU 101 executes a program. Hardware which configures these functional units are, for example, the CPU 101, the ROM 102, the RAM 103, and the non-volatile storage unit 104.

The control unit 140 is provided with a communication control unit 141, a received data processing unit 142, an operation control unit 143, a detecting control unit 144, a cartridge data processing unit 145 and an ejecting control unit 146.

The control unit 140 executes an operating system (not illustrated). A function of the operating system is a function of a control program (not illustrated) which is stored in the storage unit 150. Each unit of the control unit 140 may be executed as a function of an application program which is executed in the operating system, and may be executed as a part of the function of the operating system.

The communication control unit 141 executes a communication with the host computer 2 using the communication unit 115 (FIG. 3). The communication control unit 141 causes the receive buffer 151 to sequentially store data which is received from the host computer 2 by the communication unit 115. The data includes various data such as a command of the host computer 2 for instructing an operation or processing with respect to the printer 1, a parameter which regulates contents of the command, and a character code, or an image data.

The received data processing unit 142 analyzes data stored in the receive buffer 151 by reading thereof, and executes detecting of a command, detecting of data which is used in printing, or the like. In a case in which a command is detected from the receive buffer 151, the received data processing unit 142 determines an executing order of the detected command, and executes the command. In addition, in a case of detecting a printing command which instructs printing, the received data processing unit 142 obtains data for printing (for example, character code or image data) which is associated with the printing command. In this case, the received data processing unit 142 generates the print data 153 for driving the printing head 31 based on the data for printing, and causes the storage unit 150 to store the print data. In addition, the received data processing unit 142 may execute data processing based on the command detected in the receive buffer 151, and for example, performs setting processing corresponding to the setting command which is received from the host computer 2.

The operation control unit 143 executes the command which is detected by the received data processing unit 142, and controls an operation of the printer 1. For example, the operation control unit 143 drives the transport motor 19, the carriage motor 41, and the ink ejecting driving units 121*a* to 121*f*, based on the print data 153 which is generated by the received data processing unit 142, and executes printing with respect to the printing sheet P. In addition, for example, the operation control unit 143 controls a display control by the display unit 112.

The detecting control unit 144 performs detecting of an input using the input unit 111. In this case, the detecting control unit 144 configures a reception unit along with the input unit 111. In addition, the detecting control unit 144 causes detecting using the medium detecting unit 113 to be executed. A detection result using the detecting control unit 144 is used in a control which is performed by the operation control unit 143.

The cartridge data processing unit 145 (cartridge detecting unit) controls reading by the IC reading units 34*a* to 34*d*, 39*a*, and 39*b*.

The cartridge data processing unit 145 processes data related to the sub-tank 21 and the cartridge 25 which are mounted on the carriage 30, based on a result of reading. Specifically, the cartridge data processing unit 145 generates or updates the cartridge data 154 based on the data which is read by the IC reading units 34*a* to 34*d*, 39*a* and 39*b*.

For example, the cartridge data processing unit 145 determines that the cartridge 25 is not mounted in a case in which it is not possible to detect the IC 26*a* when performed reading by the IC reading unit 39*a*. In addition, for example, in a case in which data is not read from the IC 26*a*, it is determined that the cartridge 25 is not mounted on the mounting unit 37*a* corresponding to the IC reading unit 39*a*. Similarly, the cartridge data processing unit 145 determines that the cartridge 25 is not mounted on the mounting unit 37*b* corresponding to the IC reading unit 39*b*, in a case in which it is not possible to detect the IC 26*b*, or a case in which data is not read from the IC 26*b*.

The cartridge data processing unit 145 performs setting with respect to the cartridge data 154 based on the data which is read by the IC reading unit 39*a*. For example, the cartridge data processing unit 145 sets data denoting a use state of the cartridge data 154 and a supply of ink, in a case in which the cartridge 25 mounted on the mounting unit 37*a* reads data denoting that liquid other than ink which is used in printing is accommodated. The cartridge data processing unit 145 also can similarly treat data which is read by the IC reading unit 39*b*.

4. Operation of Printer

Figure 6:
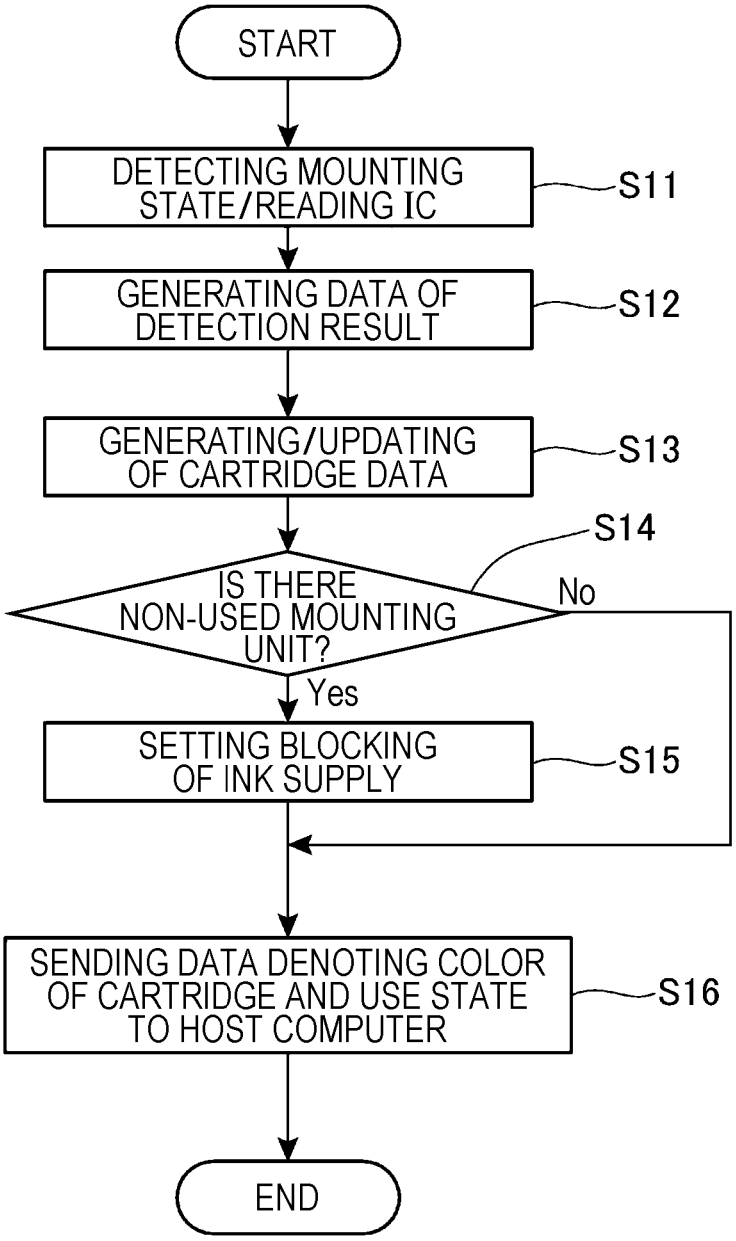
FIG. 6 is a flowchart which illustrates an operation of the printer.

FIG. 6 is a flowchart which illustrates an operation of the printer 1, and specifically illustrates an operation of the printer 1 for detecting the cartridge 25. The operation in FIG. 6 is executed when starting up the printer 1, or at a timing which is instructed by an operation of the input unit 111.

The control unit 140 detects a mounting state of the cartridge 25 in the mounting units 37*a* and 37*b*, by causing reading of the ICs 26*a* and 26*b* to be executed, using the IC reading units 39*a* and 39*b* (step S11). In a case in which the operation in FIG. 6 is executed at a time of starting up the printer 1, the control unit 140 may cause detecting by the IC reading units 34*a* to 34*d* to be executed in step S11.

The control unit 140 generates data corresponding to the cartridge data 154 based on the data which is read in reading in step S11, and a detection result of the mounting state of the cartridge 25 on each of the mounting units 37*a* and 37*b* (step S12). The control unit 140 generates or updates the cartridge data 154 based on the data generated in step S12.

Here, the control unit 140 determines whether or not there is a mounting unit which is not used in the mounting units 37*a* and 37*b* (step S14). Specifically, in a case in which a cartridge 25 which is mounted on any one of the mounting units 37*a* and 37*b* is a cartridge in which liquid other than ink is accommodated, the control unit 140 determines that the mounting unit is not used. In addition, in a case in which there is a mounting unit on which the cartridge 25 is not mounted in the mounting units 37*a* and 37*b*, the control unit 140 may determine that the mounting unit is not used.

In a case in which there is a mounting unit which is not used (Yes in step S14), the control unit 140 sets a use state of the cartridge data 154 to "non-use", sets a supply of ink to "blocking", and updates the cartridge data 154 with respect to the mounting unit which is not used (step S15).

The control unit 140 sends data denoting a color of ink or a use state of the mounting units 37*a* and 37*b* to the host computer 2 based on the cartridge data 154 (step S16). In step S16, the control unit 140 may send data denoting a color of ink or a use state with respect to the mounting unit 33. In addition, in step S16, the control unit 140 may send data denoting a residual quantity of ink with respect to the mounting units 37*a* and 37*b*.

In a case in which there is no mounting unit which is not used in the mounting units 37*a* and 37*b* (No in step S14), the control unit 140 executes processing in step S16.

In the above described processing, the control unit 140 detects a mounting state of the cartridge 25, and determines whether or not there is a mounting unit which is not used based on a detection result (step S14), by executing reading of the ICs 26*a* and 26*b* using the IC reading units 39*a* and 39*b* (step S11). In this configuration, information denoting a mounting state of the cartridge 25 corresponds to information for blocking a supply of ink for the control unit 140. The operation of the printer 1 is not limited to above described example, and for example, a mounting state or a use state of the cartridge 25 in the mounting units 37*a* and 37*b* may be designated, using an input in the input unit 111, or a command which the host computer 2 sends to the printer 1. The control unit 140 obtains the input in the input unit 111 or the command which the host computer 2 sends to the printer 1. In this case, information related to the command or input which the control unit 140 obtains corresponds to information for blocking a supply of ink. In addition, in the operation, a function of the control unit 140 for obtaining the input in the input unit 111, or the command corresponds to the function of the reception unit. That is, the control unit 140 corresponds to the reception unit. In this case, the control unit 140 may determine whether or not there is a mounting unit which is not used based on the input in the input unit 111, or the command which the host computer 2 sends to the printer 1 in step S14.

Figure 7:
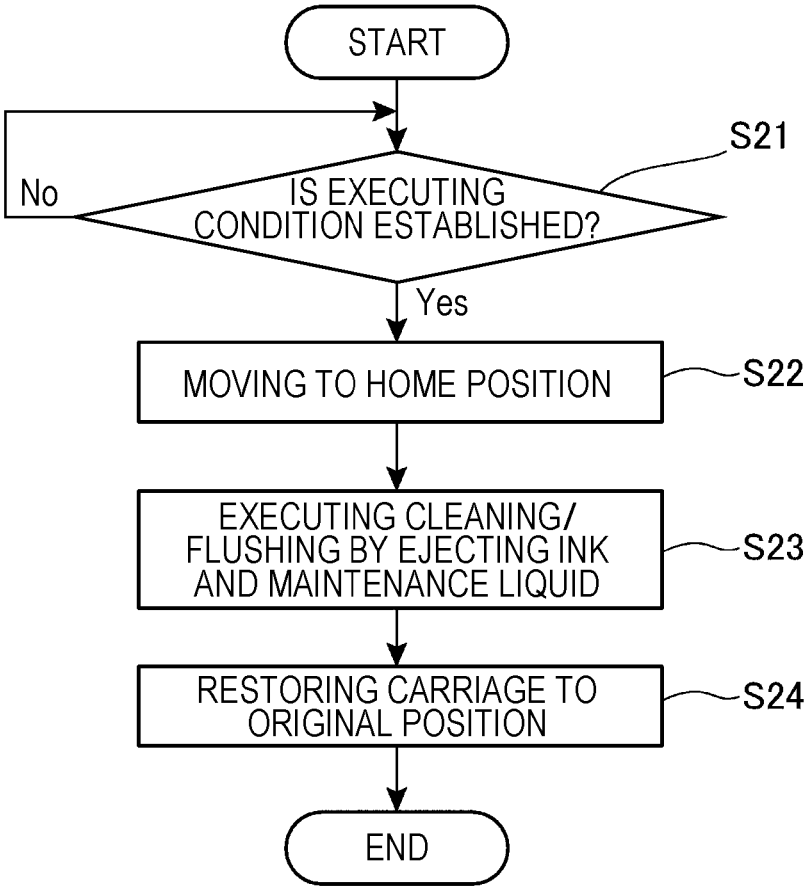
FIG. 7 is a flowchart which illustrates an operation of the printer.

FIG. 7 is a flowchart which illustrates an operation of the printer 1, and in particular, illustrates an operation in a case of executing cleaning and flushing.

The control unit 140 determines whether or not an executing condition of cleaning or flushing is established (step S21), and stands by while the executing condition is not established (No in step S21).

The executing condition of cleaning is, for example, set so as to be periodically executed based on the number of pages for performing printing on the printing sheet P, a time in which power of the printer 1 is turned on, an ejecting quantity of ink from the printing head 31, or the like. In addition, the executing condition of cleaning may include a case in which the cartridge 25 which is mounted on the mounting units 37*a* and 37*b* is exchanged, a case in which cleaning is instructed by a command which is input from the host computer 2, a case in which cleaning is instructed using an operation of the input unit 111, and the like.

The executing condition of flushing is determined depending on a time, while a printing operation with respect to the printing sheet P is being executed. Specifically, a threshold value is set with respect to a time in which printing is being performed, an ejecting quantity of ink from the printing head 31, and a time in which a state in which ink is not ejected from any one of nozzles 32*a* to 32*f* is continued, and in a case of reaching the threshold value, it is determined that the executing condition of flushing is established. The threshold value is included in the set data 152, for example.

As described above, the maintenance device 52 illustrated in FIG. 1 is provided with a cap which seals the printing head 31. The carriage 30 is located at the home position 51 in a state of not executing printing, and the printing head 31 is sealed with the cap. For this reason, flushing may not be performed in a state in which a printing operation is not executed. Accordingly, the executing condition of flushing is established at a predetermined timing during the printing operation.

In a case in which the executing condition of cleaning or flushing is established (Yes in step S21), the control unit 140 moves the carriage 30 to the home position (step S22). The control unit 140 causes ink and/or maintenance liquid to be ejected from the nozzles 32*a* to 32*f* of the printing head 31 based on a quantity and/or a time corresponding to processing to be executed (cleaning or flushing) (step S23). In this manner, cleaning or flushing is executed.

The control unit 140 restores a position of the carriage 30 to the position before being moved in step S22 (step S24), and finishes the processing. In addition, the operation in FIG. 7 can be continuously executed while power of the printer 1 is turned on.

Figure 8:
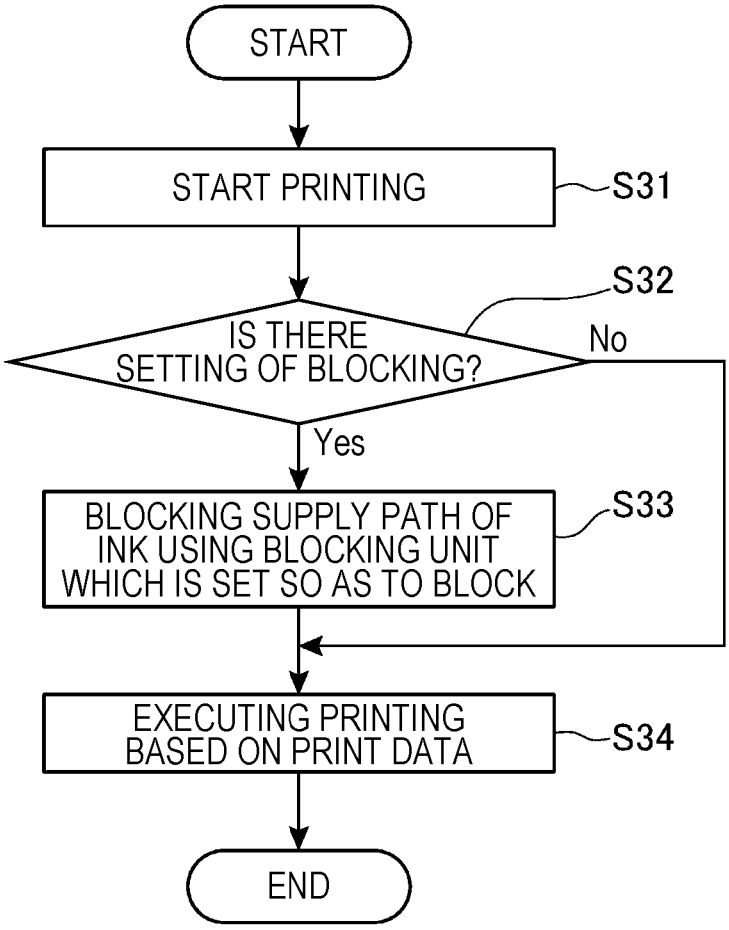
FIG. 8 is a flowchart which illustrates an operation of the printer.

FIG. 8 is a flowchart which illustrates an operation of the printer 1, and in particular, illustrates an operation in a case in which printing is performed based on the cartridge data 154.

The control unit 140 starts a printing operation in a case in which printing is instructed by a command which is received from the host computer 2 (step S31). The control unit 140 refers to the cartridge data 154, and determines whether or not a supply of ink is set to "blocking" with respect to any one of the mounting units 37*a* and 37*b* (step S32).

In a case in which a supply of ink is set to "blocking" with respect to any one of the mounting units 37*a* and 37*b* (Yes in step S32), the control unit 140 blocks a path of ink (flow path) in the carriage 30 corresponding to the mounting unit which is set to "blocking" (step S33). Specifically, the control unit 140 causes the blocking units 38*a* and 38*b* corresponding to the side in the mounting units 37*a* and 37*b* which is set to "blocking" to transfer to a blocking state.

The control unit 140 drives the transport motor 19, the carriage motor 41, and the ink ejecting driving units 121*a* to 121*f* based on the print data 153, and executes printing on the printing sheet P (step S34).

In addition, in a case in which a supply of ink is not set to "blocking" in both of the mounting units 37*a* and 37*b* (No in step S32), the control unit 140 proceeds to step S34, and executes printing.

In step S33 in FIG. 8, the control unit 140 blocks the ink path using the blocking units 38*a* and 38*b*; however, for example, the ink ejecting driving units 121*a* to 121*f* may be used. Specifically, a supply of ink may be blocked (limited) by using the ink ejecting driving units 121*e* and 121*f* which cause ink to be ejected from the nozzles 32*e* and 32*f* corresponding to the mounting units 37*a* and 37*b*. Specifically, in a case in which a supply of ink is set to "blocking" in the cartridge data 154 with respect to the mounting unit 37*a*, the control unit 140 performs a control of stopping an operation of the ink ejecting driving unit 121*e* in the middle of printing. In this manner, ink or liquid is not ejected from the nozzle 32*e* corresponding to the mounting unit 37*a*, and it is possible to expect the same effect as that in the case in which the ink flow path is blocked using the blocking unit 38*a*. In a case in which a supply of ink is set to "blocking" in the cartridge data 154 with respect to the mounting unit 37*a*, similarly, the control unit 140 performs a control of stopping an operation of the ink ejecting driving unit 121*f* in the middle of printing. In this case, the ink ejecting driving units 121*e* and 121*f* execute the same function as that of the supply blocking unit. In addition, in this case, it may be a configuration in which the blocking units 38*a* and 38*b* are omitted.

5. Use Example of Color of Ink

Here, a specific example of a color of ink of the sub-tanks 21*a* to 21*d* and the cartridges 25*a* and 25*b* will be described.

For example, it is possible to set a color of ink stored in the ink tanks 22*a* to 22*d* to a basic color which is used in printing by the printer 1. The basic color is a basic color which is used in subtractive color mixing (C, M, Y, K) in a case in which the printer 1 performs color printing. The ink of basic colors may be stored in the ink tanks 22*a* to 22*d*. In this case, it is possible to perform printing of a full color using the ink stored in the ink tanks 22*a* to 22*d*, and it is possible to save a time of exchanging a cartridge, compared to a case in which the ink is supplied, using the cartridge 25.

Meanwhile, a color of ink accommodated in the cartridges 25*a* and 25*b* can be set to a color which is not a basic color (for example, basic color which is used in subtractive color mixing) which is used in printing by the printer 1. For example, it is a color of red (R), green (G), a fluorescent color, a metallic color. In addition, a cartridge 25 in which ink of a pale color such as light magenta (LM) or light cyan (LC) which is used in high quality printing (so-called photo printing, or the like) is accommodated may be used. The color is not highly necessary when printing a general document in the printer 1; however, the color is a so-called specific color which is used in a case of performing printing for a specific use or a specific color tone. Since the cartridges 25*a* and 25*b* can be exchanged, it is possible to mount the cartridge 25 in which ink of R, G, a fluorescent color, and a metallic color are accommodated on the carriage 30 as needed, or exchange thereof. For this reason, it is possible to print various printed matters by combining ink of basic color stored in the ink tanks 22*a* to 22*d* and ink of a specific color which is accommodated in the cartridge 25. In addition, it is possible to use or exchange the ink of a specific color, in a state in which the ink of the basic color used in subtractive color mixing can be used in the printer 1.

Liquid for maintenance which is accommodated in the cartridge 25*a* is, for example, a cleaning solvent which cleans an ink flow path from the mounting unit 37*a* to the nozzle 32*e*, liquid which prevents drying of the flow path, or the like, in the carriage 30. It is the same in a case in which the cartridge 25*b* accommodates the maintenance liquid. In a case in which it is not possible to use the mounting unit 37*a* or 37*b* in printing, when the maintenance liquid is accommodated in the cartridge 25*a* or 25*b*, it is possible to preferably maintain a state of the printer 1. In this manner, the cartridge 25 in which liquid other than ink is accommodated can be referred to as a dummy cartridge or a substitute cartridge. In the mounting units 37*a* and 37*b*, it is also possible to set a state in which the cartridge 25 is not mounted. However, it is preferable that the mounting units 37*a* and 37*b* not be opened or exposed to the atmosphere, in a viewpoint of preventing entering of dust into the ink flow path from the mounting units 37*a* and 37*b*, or excessive drying of the ink flow path. When blocking the ink flow path from the mounting units 37*a* and 37*b* to the nozzles 32*e* and 32*f*, there is no concern that maintenance liquid may be ejected to the printing sheet P, even when the cartridge 25 in which maintenance liquid is accommodated is mounted on the mounting units 37*a* and 37*b*. For this reason, it is possible to protect the mounting units 37*a* and 37*b* in a case in which it is possible to perform printing, using only the ink tanks 22*a* to 22*d* by mounting the cartridge 25 configured as a substitute cartridge on the mounting units 37*a* and 37*b*. In this manner, since a condition of the ink flow path becomes good in a case of mounting the cartridge 25 in which ink is accommodated on mounting units 37*a* and 37*b* which are not used, it is possible to rapidly start printing in which ink of the cartridge 25 is used.

As described above, the printer 1 according to the embodiment to which the invention is applied is provided with the printing head 31 which ejects ink of a plurality of colors, and the mounting units 37*a* and 37*b* on which the cartridge 25 accommodating ink can be mounted. In addition, the printer is provided with the carriage 30 which includes the mounting units 37*a* and 37*b*, and the printing head 31, the ink tank 22 which is disposed at a position different from that of the carriage 30, and stores ink, and a control unit 140 which controls ejecting of ink using the printing head 31. In a case of obtaining information for blocking ejecting of ink corresponding to the mounting units 37*a* and 37*b*, the control unit 140 of the printer 1 blocks ejecting of ink corresponding to the mounting unit from the printing head 31.

According to the printer 1 to which the printing apparatus in the invention and a control method of the printing apparatus are applied, the printer 1 provided with the mounting units 37*a* and 37*b* mounted with the cartridge 25 and the ink tank 22 can block ejecting of ink corresponding to the mounting units 37*a* and 37*b*. For example, it is possible to perform an operation of printing without using ink accommodated in the cartridge 25. Accordingly, it is possible to perform printing by taking advantage of each of the ink tank 22 and the cartridge 25.

In addition, the printer 1 is provided with the plurality of mounting units 37*a* and 37*b* on which the cartridge 25 can be mounted. The control unit 140 blocks ejecting of ink corresponding to the mounting units 37*a* and 37*b* with respect to any one or more of the plurality of mounting units 37*a* and 37*b*. In this manner, it is possible to perform printing by using ink stored in the ink tank 22 without causing ink accommodated in the cartridge 25 to be ejected. For this reason, it is possible to mount the cartridge 25 in which ink with a low use frequency is accommodated on the mounting units 37*a* and 37*b*, or perform printing without mounting the cartridge 25 on the mounting units 37*a* and 37*b*. Accordingly, it is possible to properly use the ink tank 22 and the cartridge 25, and perform printing by taking advantage of each of the ink tank 22 and the cartridge 25.

The printer 1 is provided with the cartridge data processing unit 145 which detects at least any one of a mounting state of the cartridge 25 on the mounting units 37*a* and 37*b* and a state of the cartridge 25 which is mounted on the mounting units 37*a* and 37*b*. For example, the cartridge data processing unit 145 detects a mounting state of the cartridge 25 on the mounting units 37*a* and 37*b*. The control unit 140 obtains a detection result of the cartridge data processing unit 145, and blocks ejecting of ink from the printing head 31 based on the detection result. For example, the control unit 140 blocks ejecting of ink corresponding to the mounting unit on which the cartridge 25 is not mounted. In this manner, it is possible to block ejecting of ink corresponding to the mounting units 37*a* and 37*b* in response to a mounting state of the cartridge 25 on the mounting units 37*a* and 37*b*, and/or a state of the cartridge 25 which is mounted on the mounting units 37*a* and 37*b*. For example, the control unit 140 blocks ejecting of ink from the nozzles 32*e* and 32*f* corresponding to the mounting units 37*a* and 37*b* in a case in which the cartridge 25 accommodating ink is not mounted on the mounting units 37*a* and 37*b* using the cartridge data processing unit 145.

In this manner, it is possible to execute an operation in a state in which the cartridge 25 is not mounted, properly use the ink tank 22 and the cartridge 25, and perform printing by taking advantage of each of the ink tank 22 and the cartridge 25.

The reception unit which receives an input of information related to the cartridge 25 which is mounted on the mounting units 37*a* and 37*b* may be provided. The reception unit corresponds to the detecting control unit 144 which detects an input of the input unit 111, or the received data processing unit 142 which detects a command which the host computer 2 sends. The control unit 140 may be configured so as to block ejecting of ink from the printing head 31, in a case in which the reception unit receives information for blocking ejecting of ink. In this manner, it is possible to block ejecting of ink corresponding to the mounting units 37*a* and 37*b* based on information related the cartridge 25 which is input.

For example, it is possible to block ink which is accommodated in the cartridge 25 according to an input using an input operation using a switch, or the like, or an input of a command or data from the host computer 2. Accordingly, it is possible to perform printing by taking advantage of each of the ink tank 22 and the cartridge 25.

The ink ejecting unit is provided with the nozzles 32*e* and 32*f* which eject ink, and the blocking units 38*a* and 38*b* which blocks a flow path which supplies ink from the mounting units 37*a* and 37*b* to the nozzles 32*e* and 32*f*. The control unit 140 may have a configuration of blocking ejecting of ink from the printing head 31 by blocking a supply of ink from the mounting units 37*a* and 37*b* to the blocking units 38*a* and 38*b*. In this case, it is possible to block a supply of ink from the mounting units 37*a* and 37*b* to the nozzles by blocking the ink flow path. For this reason, it is possible to reliably block a supply of ink corresponding to the mounting state of the cartridge 25, or the like, in the mounting units 37*a* and 37*b*.

The printing head 31 is provided with the nozzles 32*e* and 32*f* which eject ink. In addition, the printing head is provided with the ink ejecting driving units 121*e* and 121*f* which cause ink to be ejected from the nozzles 32*e* and 32*f*. The control unit 140 may have a configuration in which ejecting of ink from the printing head 31 is blocked by causing the ink ejecting driving units 121*e* and 121*f* not to eject ink from the nozzles 32*e* and 32*f*. In this manner, it is possible to block ejecting of ink onto the printing sheet P from the mounting units 37*a* and 37*b* without using the blocking units 38*a* and 38*b*.

The mounting units 37*a* and 37*b* can be mounted with the cartridge 25 as a substitute cartridge in which contents other than printing ink are accommodated. The control unit 140 blocks ejecting of contents of the substitute cartridge from the printing head 31 at a time of printing in a case in which the cartridge 25 as the substitute cartridge is mounted on the mounting units 37*a* and 37*b*. In this manner, it is possible to mount the cartridge 25 in which contents different from printing ink are accommodated on the mounting units 37*a* and 37*b*. For example, it is possible to mount a cartridge 25 in which a cleaning solvent which cleans the ink flow path, liquid for preventing drying of the flow path, an object for preventing entering of dust into the flow path, or the like, is accommodated on the mounting units 37*a* and 37*b*. For this reason, it is possible to prevent entering of dust from the mounting units 37*a* and 37*b*, and maintain a state of the printer 1 good without mounting the cartridge 25 in which ink is accommodated. In addition, it is possible to block ejecting of contents of the substitute cartridge at a time of printing, and prevent contents different from printing ink from having an influence on printing.

The cartridge 25 as a substitute cartridge may accommodate liquid for maintenance (maintenance liquid) of the printer 1 as contents. According to the configuration, it is possible to maintain a state of the printer 1 good without mounting the cartridge 25 in which ink is accommodated. In addition, since a condition of the ink flow path is good when mounting the cartridge 25 in which ink is accommodated, it is possible to rapidly start printing in which ink of the cartridge 25 is used.

A color of ink stored in the ink tank 22 can be set to at least any one of colors of yellow, magenta, cyan, and black. In this case, printing is performed by taking advantage of the ink tank 22, using ink of a basic color in subtractive color mixing by storing thereof. For example, it is possible to make the ink tank 22 have a larger capacity than that of the cartridge 25 which is mounted on the mounting units 37*a* and 37*b* of the carriage 30, since the ink tank 22 is disposed at a position different from that of the carriage 30. For this reason, it is possible to save a time of exchanging the cartridge 25 by storing ink which is consumed a lot in printing in which subtractive color mixing is used in the ink tank 22, and there is an advantage of reducing a printing cost.

A color of ink accommodated in the cartridge 25 may be a color which is not the basic color in subtractive color mixing. In this case, it is possible to easily change ink of a color other than the basic color by exchanging the cartridge 25, by supplying ink which is not the basic color in subtractive color mixing using the cartridge 25. In addition, it is possible to print various printed matters by combining ink stored in the ink tank 22 and ink supplied by the cartridge 25. In addition, in a case in which the basic color which is used in subtractive color mixing is stored in the ink tank 22, for example, it is possible to use ink of a color other than the basic color, or exchange thereof in a state in which printing can be performed using ink of the basic color.

A color of ink accommodated in the cartridge 25 can be set to a color of any one of red, green, a fluorescent color, and a metallic color. In this case, ink of a color which is not the basic color in subtractive color mixing, and of which a use is limited is supplied by the cartridge 25. There is an advantage that ink is hardly deteriorated in the ink accommodated in the cartridge 25, and it is possible to prevent deterioration in printing quality by supplying the ink of a color of which a use frequency is low, using the cartridge 25. In addition, since the cartridge 25 can be easily exchanged, it is possible to easily change a color of ink. Accordingly, it is possible to perform printing by taking advantage of supplying ink from the cartridge 25.

The above described embodiment merely exhibits one form of the invention, and it is possible to make an arbitrary modification and application in the scope of the invention.

For example, in the above described embodiment, the configuration in which the blocking units 38*a* and 38*b* which are built in the carriage 30 are used as the blocking unit which blocks the ink flow path which extends from the cartridges 25*a* and 25*b* to the nozzles 32*e* and 32*f* is exemplified. The invention is not limited to this, and for example, the same configuration as that of the blocking units 38*a* and 38*b* which blocks a supply of ink may be provided in the cartridges 25*a* and 25*b*.

In addition, in the above described embodiment, a configuration in which the cartridge data 154 is set by a command which the host computer 2 sends, or the host computer 2 sends the cartridge data 154 to the printer 1 may be adopted.

The printer 1 which is described in the above described embodiment is a color printer in which ink of four colors are set to the ink of the basic color; however, it is merely an example. The printer 1 may be a printer which performs printing by using colors of three or less, and may be a color printer which performs printing by using much more colors, without being limited to four colors. For example, it may be a configuration in which ink of three colors or less in total are stored in the ink tanks 22*a* to 22*d*. The number of ink tanks 22 may be set to three or less. Also the number of nozzles which are formed in printing head 31 is not limited, and is not limited to 6 rows. Specifically, it may be a configuration in which ejecting can be performed so that ink is not mixed corresponding to the number of colors which is used in the printer 1, and may be a configuration in which it is possible to allocate ink of the sub-tank 21 and the cartridge 25 to different nozzles. For example, it may be a configuration in which a plurality of nozzles which configure one nozzle column are allocated to different sub-tank 21 or cartridge 25.

The printer 1 is not limited to the configuration in which the carriage 30 is subject to scanning in a direction different from the transport direction F, and for example, may be a so-called line head printer in which the carriage 30 is not subject to scanning. The printer 1 may be a large-sized printer which performs printing on a printing sheet P with a size A1, A0, or larger than that, or a printing medium such as cloth.

The configuration of the ink ejecting driving units 121*a* to 121*f* which cause ink to be ejected by the printing head 31 may be piezoelectric method in which piezoelectric element is used, or may be a configuration in which ink is ejected, using heat.

The printer 1 is not limited to an independent apparatus as a printing apparatus, and may be a printer module which is incorporated in another apparatus.

Each functional unit which is illustrated in FIGS. 3 and 4 illustrates a functional configuration, and a specific mounting form is not particularly limited. That is, it is not essential to provide hardware individually corresponding to each functional unit, and as a matter of course, it is also possible to set a configuration in which functions of a plurality of the functional units are executed when one processor executes a program. In addition, in the above described embodiment, a part of function which is executed by software may be executed by hardware, or a part of function executed by hardware may be executed by software. In addition to that, a specific detailed configuration of each unit of the printer 1 other than that can be arbitrarily changed without departing from the scope of the invention.

The entire disclosure of Japanese Patent Application No. 2017-077369, filed Apr. 10, 2017 is expressly incorporated by reference herein.

What is claimed is:

1. A printing apparatus comprising;

an ink ejecting unit which ejects ink of a plurality of colors;

a mounting unit on which a cartridge which accommodates ink is mounted;

a carriage provided with the mounting unit and the ink ejecting unit;

an ink storage unit which is disposed at a position different from the carriage, and stores ink;

a sub-tank mounted on the carriage and storing ink received from the ink storage unit, wherein the sub-tank is mounted on the carriage at a different position in a scanning direction of the carriage than the position on the carriage that the mounting unit mounts the cartridge; and a control unit which controls ejecting of ink using the ink ejecting unit, and a blocking unit built in the mounting unit and having a function of blocking a supply of ink;

wherein the control unit can be switched between a state of blocking a supply of ink and a state of supplying ink, and wherein in a case of obtaining information for blocking ejecting of the ink corresponding to the mounting unit, the control unit blocks ejecting of the ink corresponding to the mounting unit from the ink ejecting unit.

2. The printing apparatus according to claim 1, further comprising:

a plurality of the mounting units which can be mounted with the cartridges, wherein the control unit blocks ejecting of the ink corresponding to the mounting unit with respect to any one or more of the plurality of mounting units.

3. The printing apparatus according to claim 1, further comprising:

a cartridge detecting unit which detects a mounting state of the cartridge in the mounting unit, wherein the control unit blocks ejecting of the ink corresponding to the mounting unit on which the cartridge is not mounted, in a case in which the cartridge detecting unit detects that the cartridge which accommodates ink is not mounted on the mounting unit.

4. The printing apparatus according to claim 1, further comprising:

a reception unit which receives an input of information related to the cartridge which is mounted on the mounting unit, wherein the control unit blocks ejecting of the ink from the ink ejecting unit, in a case in which the reception unit receives information for blocking ejecting of the ink.

5. The printing apparatus according to claim 1, wherein the ink ejecting unit is provided with a nozzle which ejects the ink, and a supply blocking unit which blocks a flow path for supplying ink to the nozzle from the mounting unit, and wherein the control unit blocks ejecting of the ink from the ink ejecting unit by causing the supply blocking unit to block a supply of the ink from the mounting unit.

6. The printing apparatus according to claim 1, wherein the ink ejecting unit is provided with the nozzle which ejects the ink, and an ejecting driving unit which causes ink to be ejected from the nozzle, and wherein the control unit blocks ejecting of the ink from the ink ejecting unit by causing the ejecting driving unit not to eject the ink from the nozzle.

7. The printing apparatus according to claim 1, wherein the mounting unit can be mounted with a substitute cartridge in which contents other than printing ink are accommodated, and wherein the control unit blocks ejecting of contents of the substitute cartridge from the ink ejecting unit at a time of printing, in a case in which the substitute cartridge is mounted on the mounting unit.

8. The printing apparatus according to claim 7, wherein the contents accommodated in the substitute cartridge are liquid for maintenance of the printing apparatus.

9. The printing apparatus according to claim 1, wherein a color of ink stored in the ink storage unit is at least any one of colors of yellow, magenta, cyan, and black.

10. The printing apparatus according to claim 1, wherein a color of ink accommodated in the cartridge is a color which is not a basic color in subtractive color mixing.

11. The printing apparatus according to claim 10, wherein the color of ink accommodated in the cartridge is any one of colors of red, green, fluorescent, and metallic.

12. A control method of a printing apparatus which includes an ink ejecting unit which ejects ink of a plurality of colors; a mounting unit on which a cartridge which accommodates ink can be mounted; a carriage provided with the mounting unit and the ink ejecting unit disposed on the carriage; an ink storage unit which is disposed at a position different from the carriage, and stores ink, a sub-tank mounted on the carriage and storing ink received from the ink storage unit, wherein the sub-tank is mounted on the carriage at a different position in a scanning direction of the carriage than the position on the carriage that the mounting unit mounts the cartridge; and a blocking unit built in the mounting unit and having a function of blocking a supply of ink, the method comprising:

switching between a state of blocking a supply of ink and a state of supplying ink, and blocking ejecting of the ink corresponding to the mounting unit from the ink ejecting unit, in a case of obtaining information for blocking ejecting of the ink corresponding to the mounting unit.

* * * * *